US006560827B1

(12) United States Patent
Gross

(10) Patent No.: US 6,560,827 B1
(45) Date of Patent: May 13, 2003

(54) ELASTOMERIC GASKET FOR SLING RAIL FURNITURE

(76) Inventor: Jan S. Gross, 825 S. Osprey Ave., Suite 303, Sarasota, FL (US) 34236

( * ) Notice: Subject to any disclaimer, the term of this patent is extended or adjusted under 35 U.S.C. 154(b) by 0 days.

(21) Appl. No.: 09/682,291

(22) Filed: Aug. 14, 2001

(51) Int. Cl.[7] ..... A47C 5/18; A47C 7/00; A47C 31/02

(52) U.S. Cl. ..... 24/265 C; 24/265 EE; 24/300; 24/460; 24/630; 5/120; 5/160; 297/440.11

(58) Field of Search ..... 24/630, 300, 265 C, 24/265 EE, 335, 716, 459, 460, 517; 5/120, 160; 297/440.11, 440.22

(56) References Cited

U.S. PATENT DOCUMENTS

| | | | | | |
|---|---|---|---|---|---|
| 2,586,262 | A | * | 2/1952 | Robins | 24/265 C |
| 2,823,155 | A | * | 2/1958 | Brown et al. | 24/265 C |
| 2,832,399 | A | * | 4/1958 | Varkala | 24/265 C |
| 2,876,827 | A | * | 3/1959 | Mirrione | 24/265 C |
| 2,979,119 | A | * | 4/1961 | Kramer | 24/265 C |
| 3,175,269 | A | * | 3/1965 | Raduns et al. | 24/265 C |
| 3,298,426 | A | * | 1/1967 | Kramer | 24/265 C |
| 3,427,693 | A | * | 2/1969 | Adams | 24/265 C |
| 3,464,479 | A | * | 9/1969 | Baker | 24/265 C |
| 3,640,576 | A | | 2/1972 | Morrison et al. | |
| 4,339,488 | A | * | 7/1982 | Brokmann | 428/100 |
| 4,541,150 | A | * | 9/1985 | Brokmann | 24/265 C |
| 4,631,786 | A | * | 12/1986 | Curry | 24/460 |
| 5,062,184 | A | * | 11/1991 | Rowland | 24/300 |
| 5,318,348 | A | | 6/1994 | Hess | |
| 5,518,292 | A | | 5/1996 | Cozzani | |
| 5,524,754 | A | * | 6/1996 | Hollingsworth | 206/320 |
| 5,716,101 | A | | 2/1998 | Frinier et al. | |
| 5,762,403 | A | | 6/1998 | Robinson | |
| 5,878,467 | A | * | 3/1999 | Yokota | 24/265 EE |
| 5,911,478 | A | | 6/1999 | Goodman | |
| 6,264,279 | B1 | | 7/2001 | Chow | |
| 6,292,987 | B1 | * | 9/2001 | Combes | 24/459 |

* cited by examiner

*Primary Examiner*—Victor Sakran
(74) *Attorney, Agent, or Firm*—Anton J. Hopen; Smith & Hopen, P.A.

(57) ABSTRACT

The present invention is an elastomeric sling furniture gasket including a substantially rod shaped member adapted to be longitudinally received and laterally retained in a tubing slot, a flexible but resilient gasket sheet depending substantially the length of the rod shaped member and adapted to extend out of the tubing slot, and a fabric affixing means on the gasket sheet distal to the rod shaped member adapted to rigidly secure a fabric material forming a support area for an occupant.

10 Claims, 9 Drawing Sheets

PRIOR ART

ELASTOMERIC GASKET FOR SLING RAIL FURNITURE

BACKGROUND OF INVENTION

1. Field of Invention

This invention relates to sling rail furniture, and more particular, to an elastic gasket for cushioning the rigidity of high tensile fabrics.

2. Background of the Invention

Typical sling chairs have a frame that is made from extruded aluminum tubing assembled into a rigid frame that defines the sides of a seating area. Non-stretchable heavy fabric forming the seating area is affixed to rods that are received by channels formed in the tubing. Opposing tubing is then pulled away thereby causing the fabric to be pulled taut. Such a design is well known in the art and described by U.S. Pat. No. 6,264,279 to Chow, U.S. Pat. No. 5,911,478 to Goodman, U.S. Pat. No. 5,762,403 to Robinson, U.S. Pat. No. 5,716,101 to Frinier et al., U.S. Pat. No. 5,518,292 to Cozzani, U.S. Pat. No. 5,318,348 to Hess, and U.S. Pat. No. 3,640,576 to Morrison et al., all of which are incorporated herein by reference.

A drawback in the current design of sling chairs is that the taut configuration of the fabric does not yield to an occupant's weight and thus, is uncomfortable. Efforts to overcome this problem with resilient coil springs produce aesthetically unpleasing designs which may catch clothing or skin as the coils expand or contract with movement. Furthermore, the springs are generally constructed of metal which is subject to oxidation, particularly in salt-water areas.

Accordingly, what is needed in the art is an apparatus for providing a resiliently biased sling chair that is aesthetically pleasing, safe and corrosion resistant.

It is, therefore, to the effective resolution of the aforementioned problems and shortcomings of the prior art that the present invention is directed.

However, in view of the prior art in at the time the present invention was made, it was not obvious to those of ordinary skill in the pertinent art how the identified needs could be fulfilled.

SUMMARY OF INVENTION

The present invention comprises an elastomeric sling furniture gasket having a substantially rod shaped member adapted to be longitudinally received and laterally retained in a tubing slot, a flexible but resilient gasket sheet depending substantially the length of the rod shaped member and adapted to extend out of the tubing slot. A fabric affixing means on the gasket sheet is provided distal to the rod shaped member and adapted to rigidly secure a fabric material forming a support area for an occupant. In the construction of the furniture, two opposing tubing slots are positioned in parallel fashion. Gaskets are affixed on opposing sides of a sheet of fabric material. The gaskets are slideably received by the two opposing tubing slots which causes the fabric to be pulled taut. The elastomeric properties of the gaskets permit the fabric sheet to be displaced downward when engaged by an occupant, thereby providing a heightened level of comfort.

It is preferred that the entire gasket assembly, including the rod shaped member; gasket sheet and fabric affixing means be of unitary construction of neoprene, butyl rubber, polymer or the like. The construction material should be flexible, but resilient and capable of withstanding heat, humidity and oxidation. The gasket is preferably affixed to the fabric sheet by stitching, but may also be riveted, thermally sealed or the like. In order to provide strength and flexibility using a minimum amount of material, longitudinally space ribs may be formed on the gasket sheet.

It is therefore an object of the present invention to provide more comfortable sling-type furniture that provides some resilient movement when engaged by an occupant.

It is another object of the present invention to provide a flexible cushioning means for increasing the comfort of sling-type furniture without the use of metal coils.

It is another object of the present invention to provide a novel cushioning means for sling-type furniture which utilizes the industry standard slot-rod configuration.

It is to be understood that both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
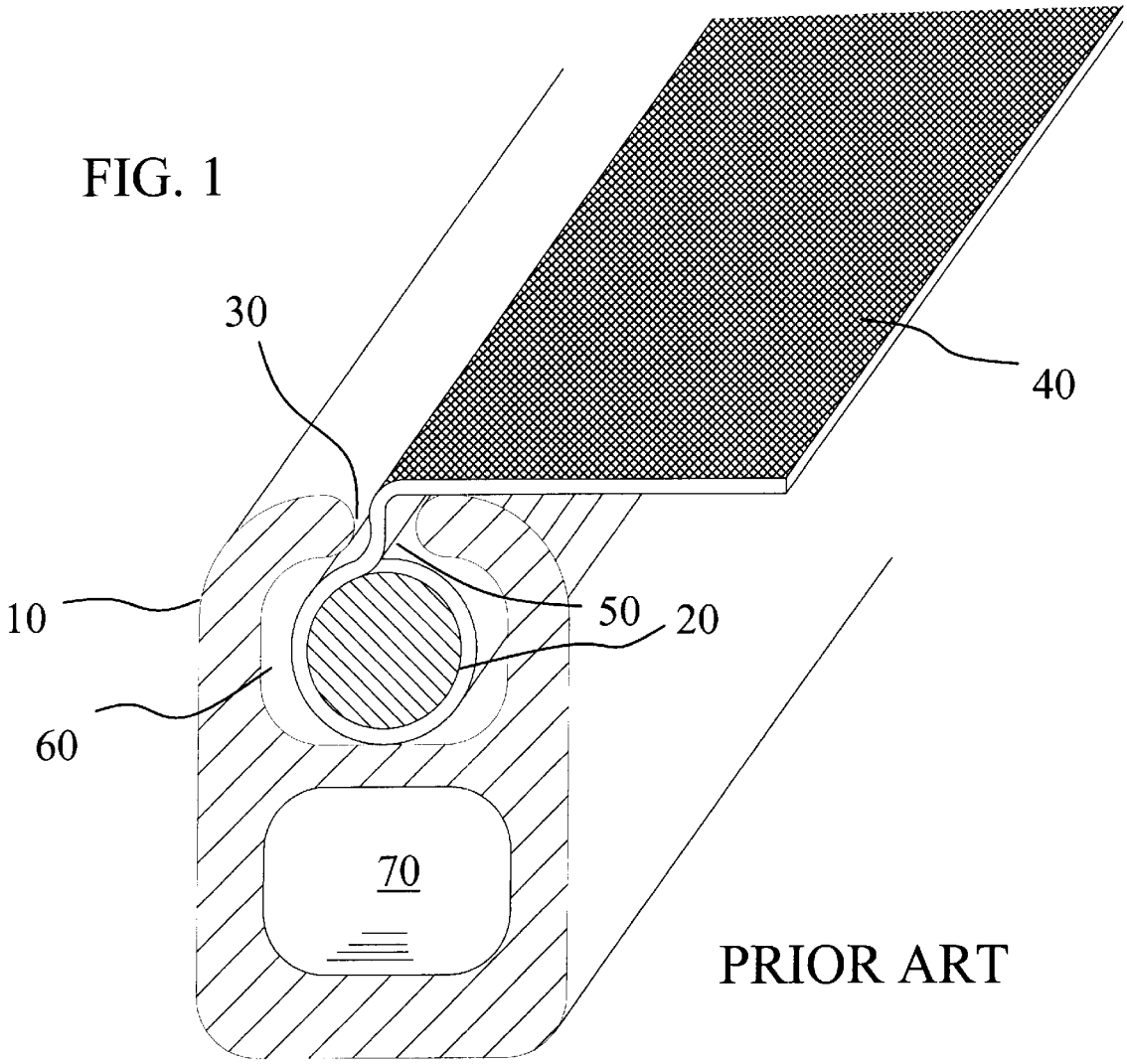
FIG. 1 is a partial sectional isometric view of the prior art.

FIG. 1 shows a prior art configuration of a typical sling furniture design. An extruded aluminum tube 10 is provided which may have voids 70 provide to reduce material and weight. A slot 60 is provided with a longitudinal opening 30. The slot 60 is fashioned to longitudinally receive a rod 20 wrapped in non-stretchable fabric 40 which is typically stitched about a wrap point 50 along on the length of the rod 20. The diameter of the rod 20 is greater than the opening of the slot 30. A mirrored assembly (not show) opposes the tube 10 and is moved to pull the fabric 40 taut. This configuration makes the fabric 40 capable of supporting an occupant of the furniture, whether it be a chair, bench, stool, lounge or the like. The drawback with the current prior art design is that the fabric is generally pulled so taut, the occupant may as well sit on a wooden board. Alternatives to provide flexibility have other drawbacks previously noted.

Figure 2:
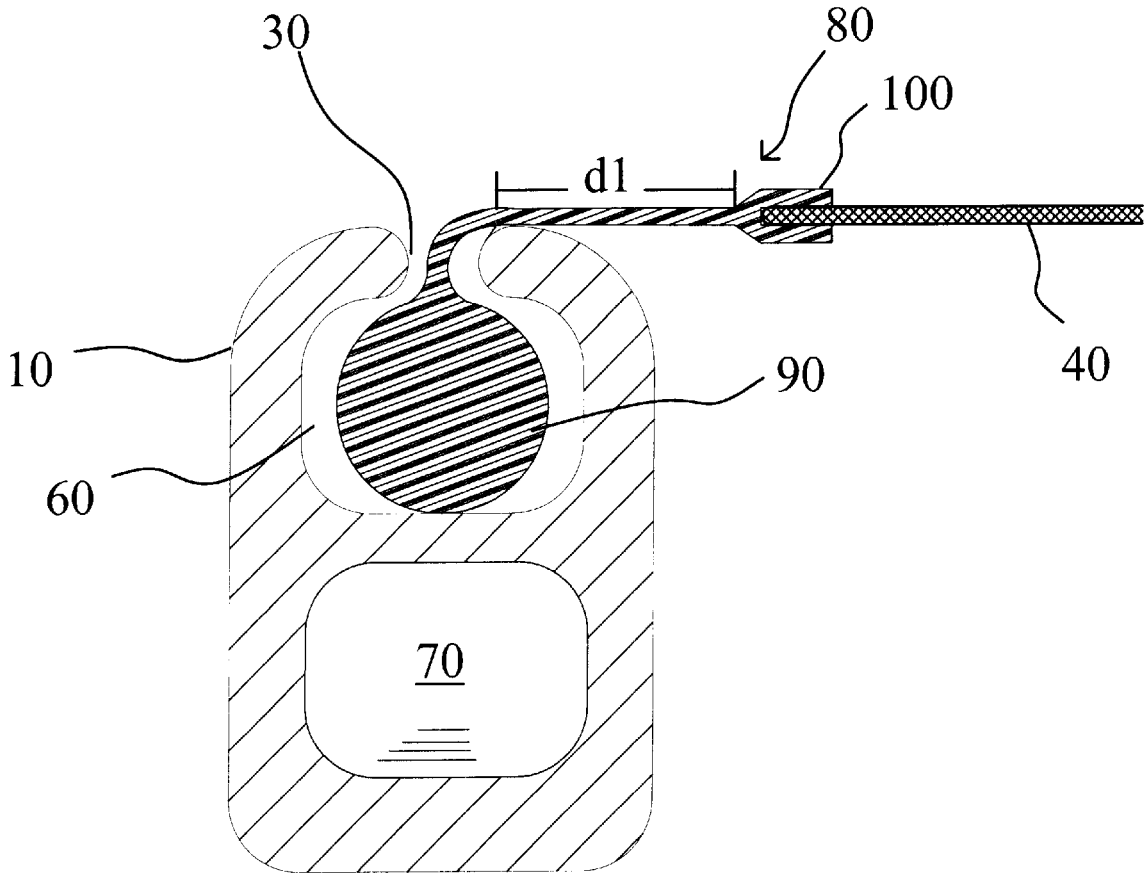
FIG. 2 is a partial sectional front elevation view of the invention.
Figure 3:
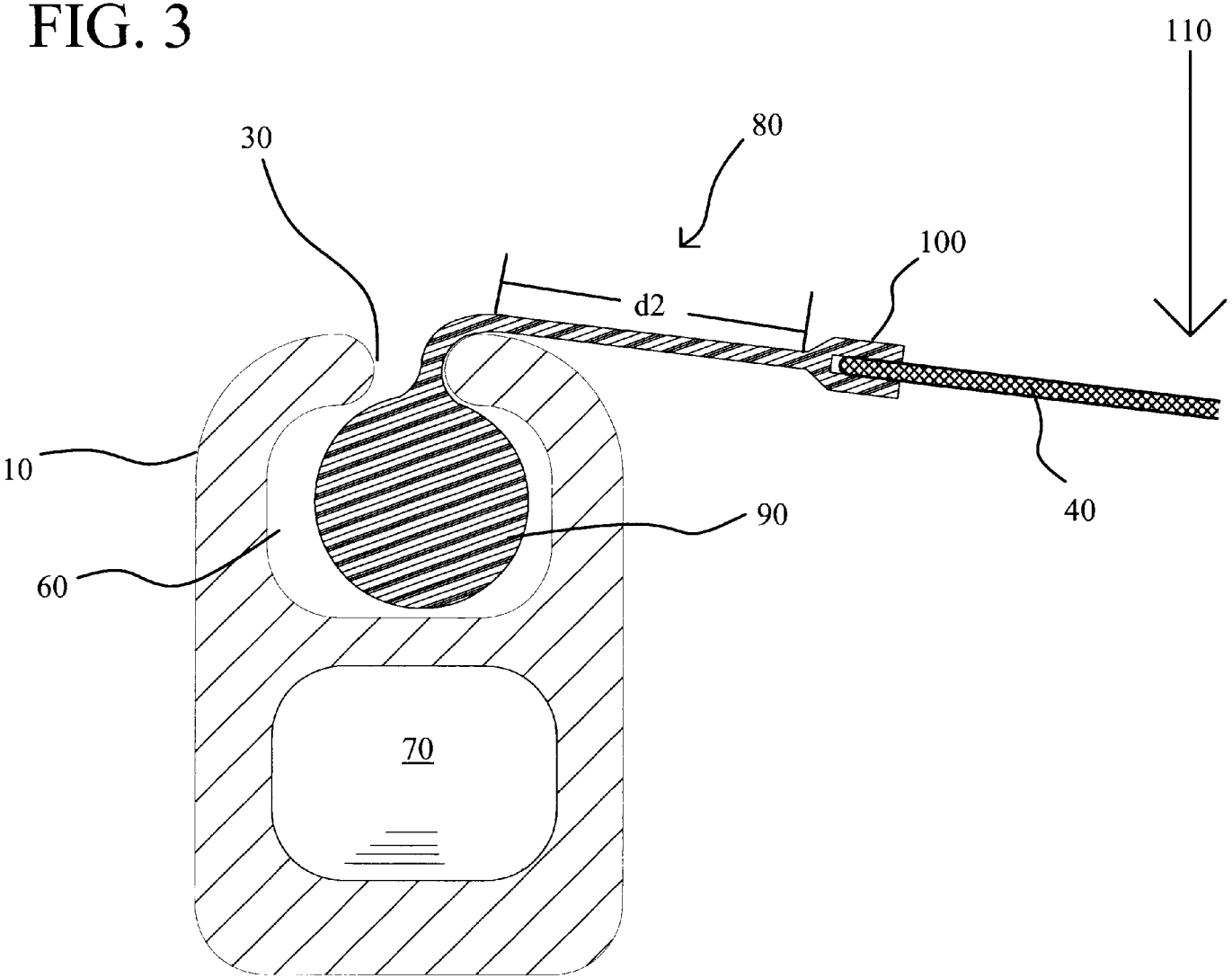
FIG. 3 is a partial sectional front elevation view of the invention wherein downward force is place on the fabric sheet.
Figure 4:
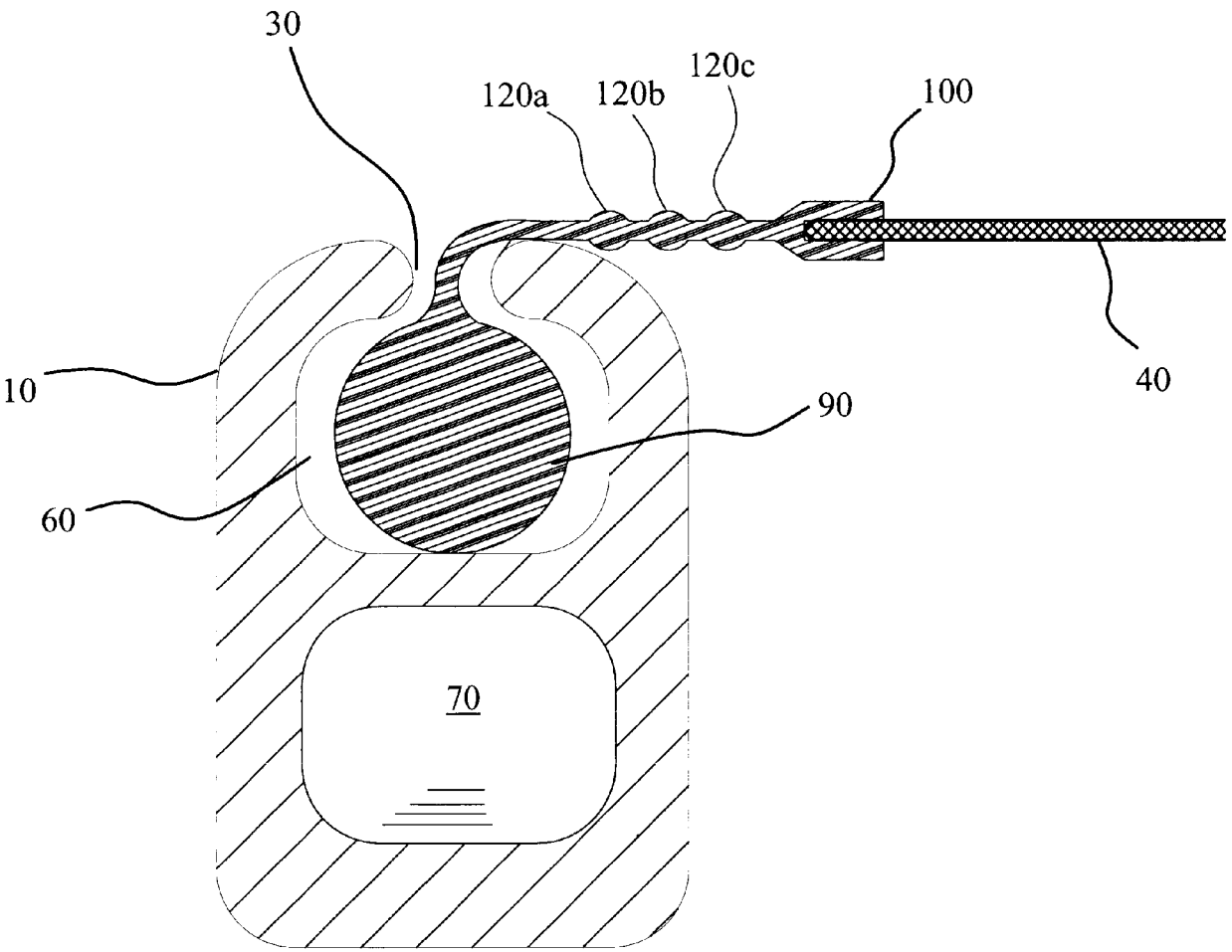
FIG. 4 is a partial sectional front elevation view of an embodiment of the invention incorporating longitudinally spaced ribs in the gasket sheet.

FIG. 2 shows an elastomeric gasket comprising a substantially rod shaped member 90 adapted to be longitudinally received and laterally retained in the tube 10. It should be noted that some interstitial space 60 is provided within the tube 10 to easily accommodate the rod shaped member 90 as the tensile forces will be incurred laterally, and not longitudinally. A flexible, but resilient gasket sheet 80 depends from the length of the rod shaped member 90 and is adapted to extend out of the tubing slot 30. A fabric affixing means 100 on the gasket sheet 80 is located distal to the rod shaped member 90 and is adapted to rigidly secure the fabric 40. To illustrate the resilient, flexible properties of the elastomeric gasket, a measurement from the tubing slot 30 to the fabric affixing means 100 is denoted as d1. In FIG. 3, a downward force 110 biases the fabric 40 in a downward direction causing the gasket sheet 80 to both bend and lengthen (d2) to accommodate the downward force 110. As a result, a cushion effect is achieved without the need of springs, foam or other added material. FIG. 4 shows an alternative embodiment of the invention which includes longitudinally spaced ribs 120*a,* 120*b* and 120*c* which provide added lateral strength.

Figure 5:
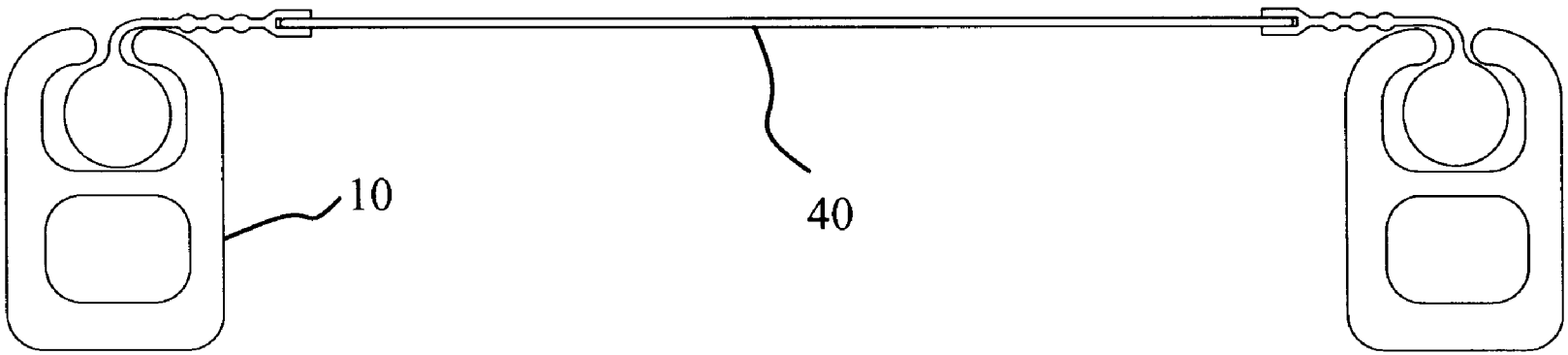
FIG. 5 is a partial sectional front elevation view of the fabric sheet pulled taut by two opposing elastomeric gaskets according to the invention.
Figure 6:
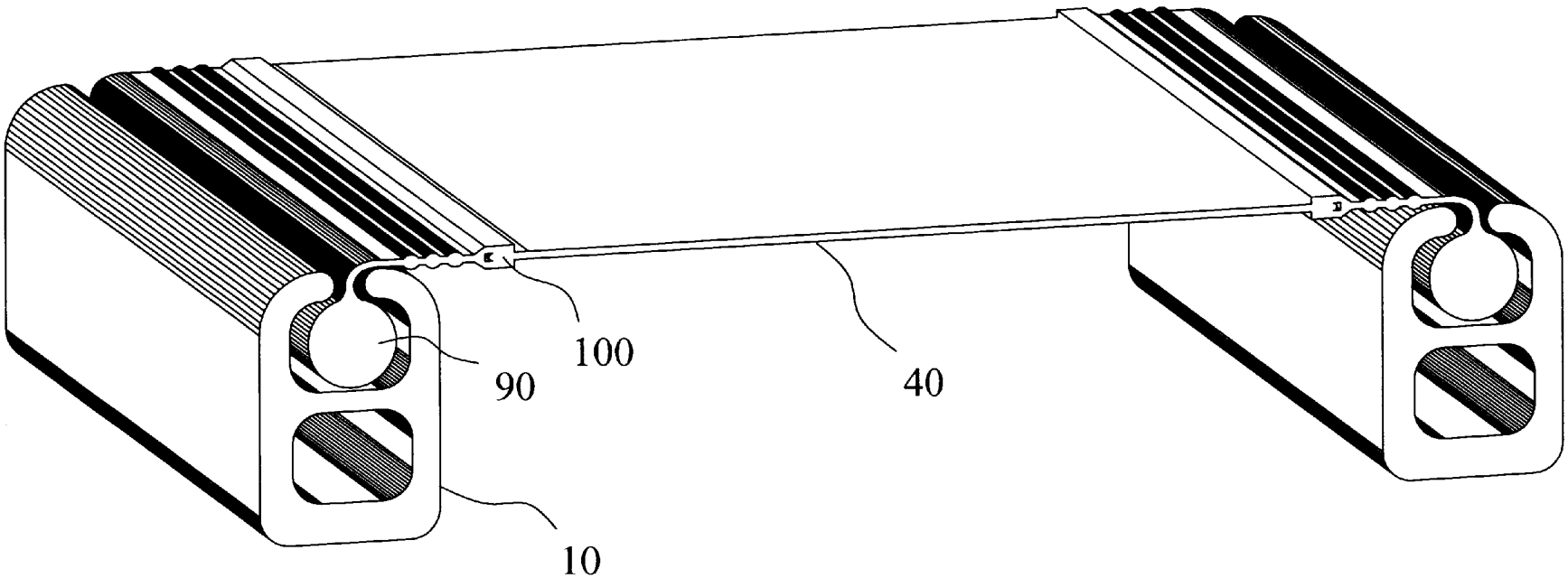
FIG. 6 is an isometric view of the fabric sheet pulled taut by two opposing elastomeric gaskets according to the invention.
Figure 7:
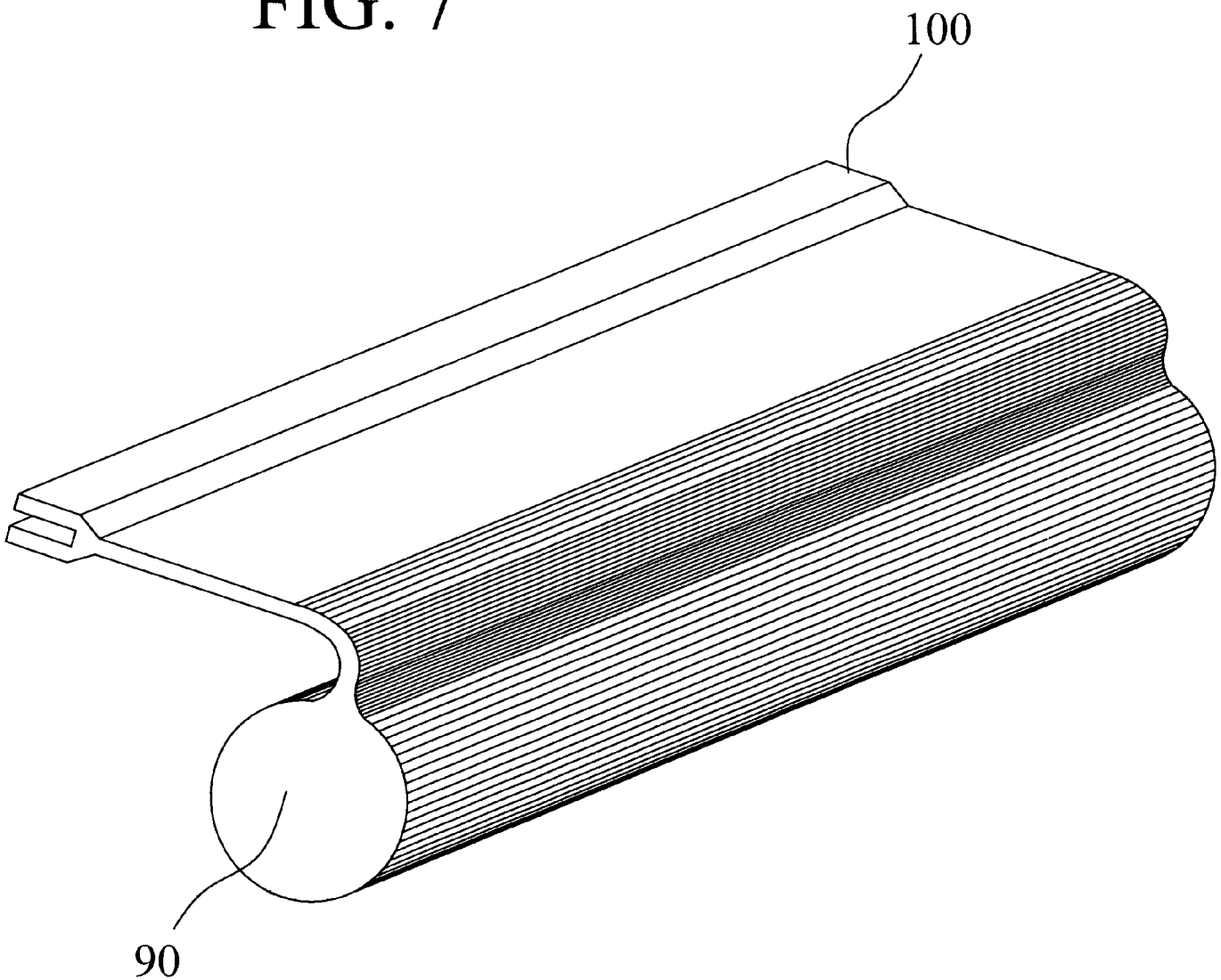
FIG. 7 is an isometric view of-the elastomeric gasket according to the invention.
Figure 8:
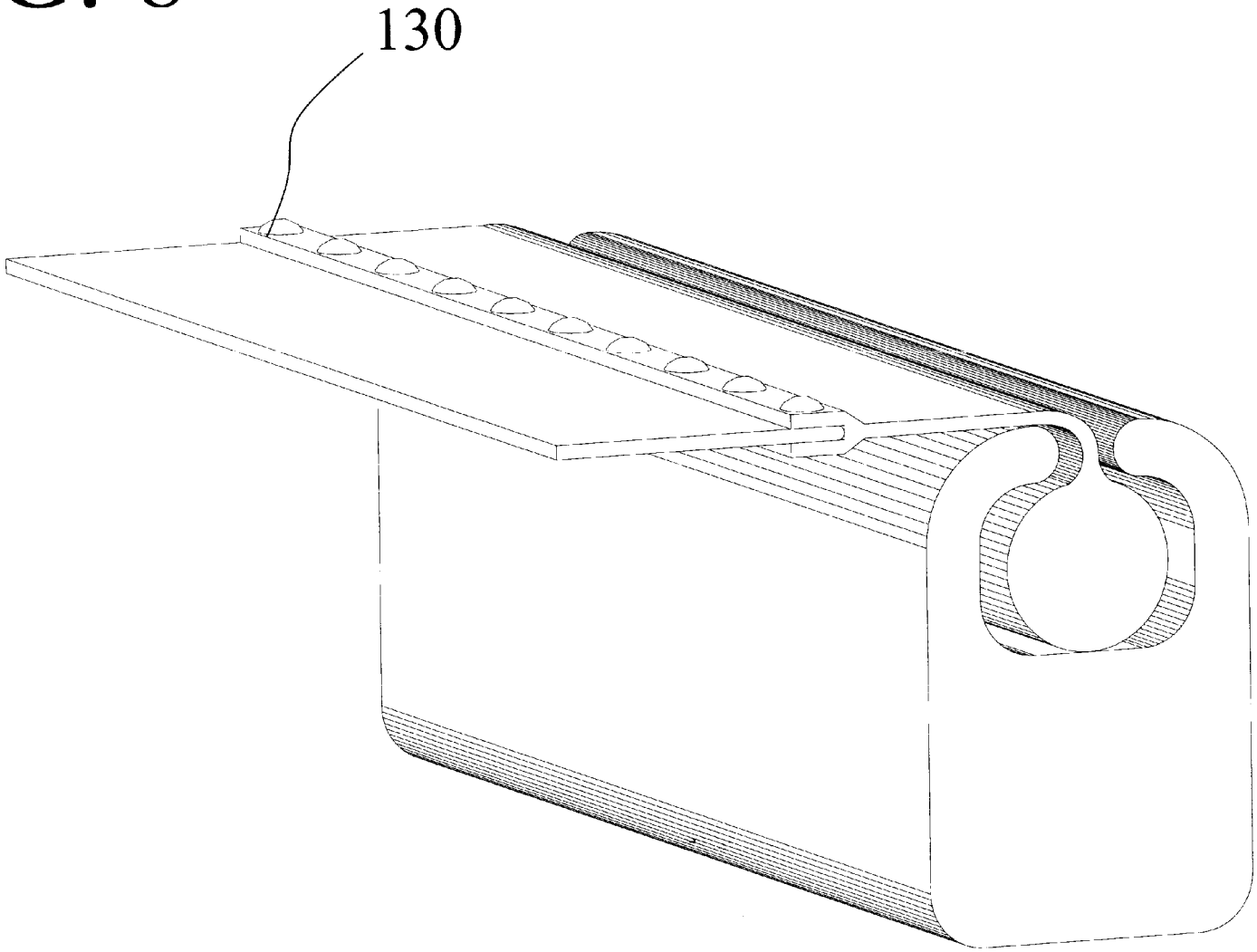
FIG. 8 is a partial-sectional isometric view of rivets attaching the fabric sheet to the elastomeric gasket.

FIG. 5 shows two opposing tubes 10 pulling the fabric 40 taut. FIG. 6 is an isomeric view wherein the embodiment of the invention employing longitudinally spaced ribs is used to affix the fabric 40 between two opposing tubes 10. FIG. 7 is a detail of an individual elastomeric gasket having the rod shaped member 90 and the fabric affixing means 100 formed of unitary construction. As noted above, the fabric affixing means 100 may utilize thermal forming, stitching or, in the case of FIG. 8, riveting. A preferred embodiment of the invention utilizes stitching, as it is the least noticeable to the occupant while still providing a strong connection.

Figure 9:
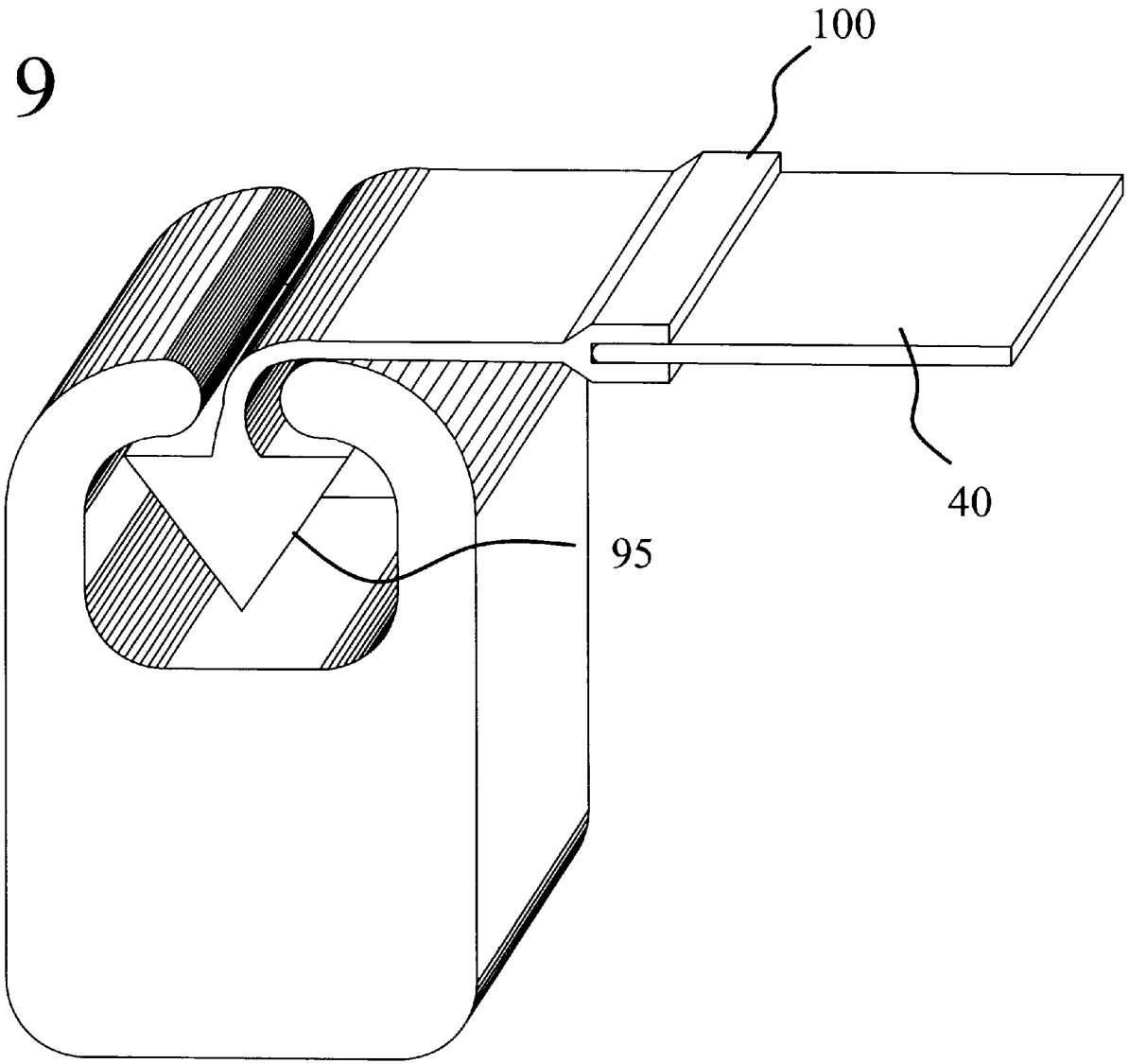
FIG. 9 is a partial sectional isometric view of an alternative embodiment of invention wherein the cross-section of the rod shaped member is arrow shaped.

FIG. 9 shows an alternative embodiment of the invention wherein the cross section of the substantially rod-shaped member is in the form of a downwardly directed arrow 95. In this embodiment, the planer surfaces of the top of the arrow disperse the compressive forces against the tube 10 when an occupant downwardly disposes the fabric 40. It should be noted that rectangular, elliptical, polygon and other predetermined geometric cross-sections are encompassed within the meaning of substantially rod-shaped member.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention, which as a matter of language, might be said to fall therebetween.

Now that the invention has been described,

What is claimed is:

1. An elastomeric sling furniture gasket comprising:

a substantially rod shaped member adapted to be longitudinally received and laterally retained in a tubing slot;

a flexible but resilient gasket sheet materially depending substantially the length of the rod shaped member and adapted to extend out of the tubing slot; and a fabric affixing means on the gasket sheet distal to the rod shaped member adapted to rigidly secure a fabric material forming a support area for an occupant.

2. The gasket of claim 1 wherein the rod shaped member, gasket sheet and fabric affixing means are of a unitary construction.

3. The gasket of claim 2 wherein the unitary construction is formed of neoprene.

4. The gasket of claim 2 wherein the unitary construction is formed of butyl rubber.

5. The gasket of claim 2 wherein the unitary construction is formed of a polymer-based material.

6. The gasket of claim 1 wherein the fabric affixing means comprises stitching.

7. The gasket of claim 1 wherein the fabric affixing means comprises riveting.

8. The gasket of claim 1 wherein the fabric affixing means comprises thermal sealing.

9. The gasket of claim 1 wherein the gasket sheet further comprises longitudinally spaced ribs.

10. An elastomeric sling furniture gasket comprising:

a substantially rod shaped member adapted to be longitudinally received and laterally retained in a tubing slot;

a flexible but resilient gasket sheet depending substantially the length of the rod shaped member and adapted to extend out of the tubing slot; and a fabric affixing means on the gasket sheet distal to the rod shaped member adapted to rigidly secure a fabric material by stitching thereby forming a support area for an occupant, the rod shaped member, gasket sheet and fabric affixing means all formed of unitary construction of neoprene.

* * * * *